US011425799B2

(12) United States Patent
Orihara et al.

(10) Patent No.: US 11,425,799 B2
(45) Date of Patent: Aug. 23, 2022

(54) HEATING COIL

(71) Applicants: HONDA MOTOR CO., LTD., Tokyo (JP); Fuji Electronics Industry Co., Ltd., Yao (JP)

(72) Inventors: Masayuki Orihara, Tochigi (JP); Hiroaki Mase, Tochigi (JP); Yasuaki Matsumoto, Tochigi (JP); Junko Tanaka, Tochigi (JP); Ryosuke Fukuchi, Tochigi (JP); Hiroko Watanabe, Osaka (JP); Yasufumi Nakai, Osaka (JP); Akihiro Hanaki, Osaka (JP)

(73) Assignees: HONDA MOTOR CO., LTD., Tokyo (JP); FUJI ELECTRONICS INDUSTRY CO., LTD., Yao (JP)

( * ) Notice: Subject to any disclaimer, the term of this patent is extended or adjusted under 35 U.S.C. 154(b) by 300 days.

(21) Appl. No.: 16/129,915

(22) Filed: Sep. 13, 2018

(65) Prior Publication Data

US 2019/0098707 A1 Mar. 28, 2019

(30) Foreign Application Priority Data

Sep. 28, 2017 (JP) ..... JP2017-189012

(51) Int. Cl.
*H05B 6/40* (2006.01)
*C21D 1/10* (2006.01)
(Continued)

(52) U.S. Cl.
CPC ..... *H05B 6/405* (2013.01); *C21D 1/10* (2013.01); *C21D 1/42* (2013.01); *C21D 9/32* (2013.01);
(Continued)

(58) Field of Classification Search
CPC . H05B 6/38; H05B 6/405; H05B 6/10; H05B 6/42; H05B 6/14; H05B 6/40;
(Continued)

(56) References Cited

U.S. PATENT DOCUMENTS 5,428,208 A * 6/1995 Chatterjee ..... C21D 9/32 219/635
6,011,246 A * 1/2000 Bonzano ..... H05B 6/365 219/640

FOREIGN PATENT DOCUMENTS

DE 102013100154 A1 * 7/2014 ..... H05B 6/405
JP 2011-014307 1/2011
JP 5570147 8/2014

* cited by examiner

*Primary Examiner* — Ibrahime A Abraham
*Assistant Examiner* — Spencer H. Kirkwood
(74) *Attorney, Agent, or Firm* — Rankin, Hill & Clark LLP

(57) ABSTRACT

A heating apparatus (2) includes a high frequency power supply (3), a left conductive plate (4), a right conductive plate (5), a left heating coil (11), and a right heating coil (12). The left heating coil (11) includes a left conductor portion (21). The left conductor portion (21) faces a gear tooth (7*a*) of a helical gear (7) and extends in a direction orthogonal to the direction in which the gear tooth (7*a*) extends. The left heating coil (11) includes a focusing magnetic body (31) which focuses magnetic flux in the left conductor portion (21) and concentrates the magnetic flux on a surface of the gear tooth (7*a*). The left heating coil (11) includes an upper inducing magnetic body (32) which induces a part of the magnetic flux flowing in a tooth root of the gear tooth (7*a*) into a tooth tip of the gear tooth (7*a*).

3 Claims, 9 Drawing Sheets

(51) Int. Cl.

| | |
|---|---|
| ***H05B 6/42*** | (2006.01) |
| ***H05B 6/10*** | (2006.01) |
| ***C21D 1/42*** | (2006.01) |
| ***C21D 9/32*** | (2006.01) |
| ***C21D 1/667*** | (2006.01) |

(52) U.S. Cl.
CPC ..... *H05B 6/101* (2013.01); *H05B 6/42* (2013.01); *C21D 1/667* (2013.01)

(58) Field of Classification Search
CPC ..... H05B 6/101; C21D 1/42; C21D 1/667; C21D 1/10; C21D 1/32
USPC ..... 219/640
See application file for complete search history.

HEATING COIL

BACKGROUND OF THE INVENTION

Field of the Invention

The present invention relates to a heating coil used in a heating apparatus for high frequency induction hardening.

Description of the Related Art

There has been known a high frequency induction hardening apparatus which performs high frequency induction hardening to harden the surface of a workpiece such as a metal gear. In such a high frequency induction hardening apparatus, a heating coil is wound around a workpiece, and current is passed through the heating coil, whereby a magnetic force is generated inside the coil, and the surface of the workpiece is heated by the magnetic force.

In order to quench-harden concave and convex portions of a workpiece (to be treated), the concave and convex portions being formed on an outer peripheral surface of the workpiece and extending in an inclination direction, a heating coil disclosed in Japanese Patent No. 5570147, includes a conductor portion extending in a direction orthogonal to the inclination direction of the concave and convex portions.

The heating coil disclosed in Japanese Patent No. 5570147 can evenly quench-harden the concave and convex portions using the conductor portion extending in a direction orthogonal to the inclination direction of the concave and convex portions. However, when the concave and convex portions are heated, magnetic flux in the convex portion of the concave and convex portions may flow in the concave portion, whereby the convex portion may not be quench-hardened.

SUMMARY OF THE INVENTION

In view of the above circumstances, the present invention has been made, and an object of the present invention is to provide a heating coil which can reliably quench-harden the concave and convex portions of the workpiece.

A heating coil of the present invention is a heating coil which heats concave and convex portions of a workpiece formed in a circular shape, the concave and convex portions extending in a direction inclined with respect to a central axis and being formed on an outer peripheral surface of the workpiece, the heating coil comprising: a conductor portion disposed outside the workpiece, formed so as to extend in a direction orthogonal to an inclination direction of the concave and convex portions, and having a facing surface where a part of the heating coil faces the concave and convex portions and a non-facing surface where the part of the heating coil does not face the concave and convex portions; a first magnetic body configured to cover the non-facing surface of the conductor portion; and a second magnetic body configured to be disposed adjacently to the first magnetic body and covers the non-facing surface and an outside portion of the facing surface located outside a portion facing the concave and convex portions.

According to the present invention, when the concave and convex portions of the workpiece are heated by a magnetic force due to electromagnetic induction generated by energizing the heating coil, the first magnetic body focuses the magnetic flux generated by the current flowing through the conductor portion and concentrates the magnetic flux on the surface of the concave and convex portions of the workpiece. Thus, the magnetic flux can be induced concentratedly onto the surface of the concave and convex portions. However, the configuration of evenly inducing the magnetic flux onto the surface of the concave and convex portions involves a problem in that the magnetic flux of the convex portion flows into the concave portion and the concave portion is concentratedly heated.

In light of this, when the concave and convex portions of the workpiece are heated by electromagnetic induction, the second magnetic body focuses the magnetic flux generated by the current flowing through the conductor portion and induces the magnetic flux onto the surface of the convex portion of the concave and convex portions of the workpiece. This can prevent heat from being concentrated on the concave portion of the concave and convex portions on which the magnetic flux is concentrated. Thus, both the convex portion and the concave portion can be reliably heated.

Further, it is preferable that the second magnetic body is formed such that a range covering the outside portion of the facing surface increases as it moves away from the first magnetic body in a circumferential direction of the workpiece.

This configuration can further prevent heat from being concentrated on the concave portion of the concave and convex portions.

Furthermore, it is preferable that the conductor portion extends spirally and a curvature in the circumferential direction of the facing surface is less than a curvature of the outer peripheral surface of the workpiece.

According to this configuration, even if the workpiece is moved in a central axis direction, the facing surface of the conductor portion faces the workpiece. Thus, the concave and convex portions of the workpiece can be heated while moving the workpiece in the central axis direction.

The present invention can reliably quench-harden the concave and convex portions of the workpiece.

DETAILED DESCRIPTION OF THE PREFERRED EMBODIMENTS

Hereinafter, embodiments of the present invention will be described with reference to the accompanying drawings.

Figure 1:
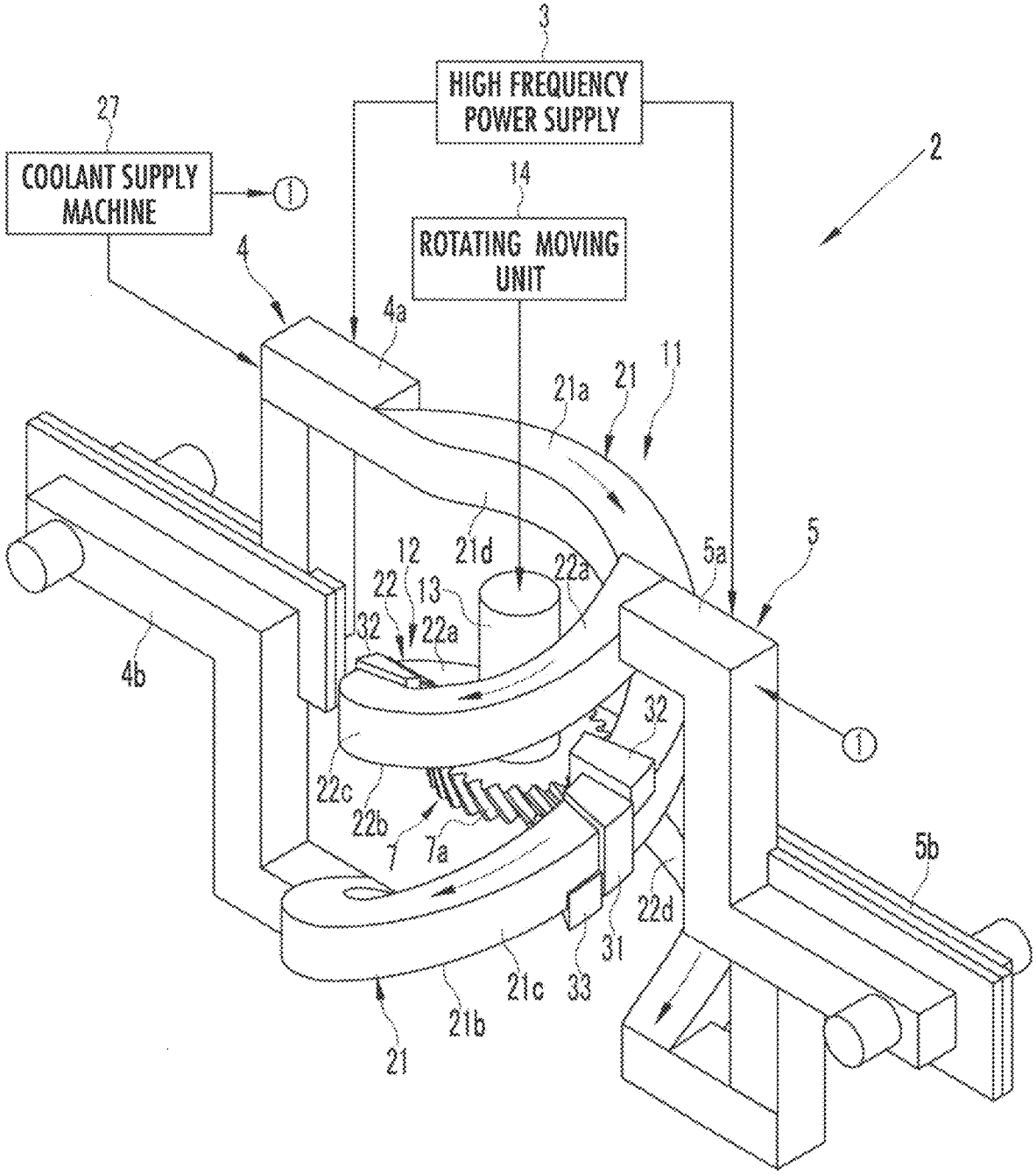
FIG. 1 is a schematic perspective view illustrating a heating apparatus having a heating coil of the present invention.
Figure 2:
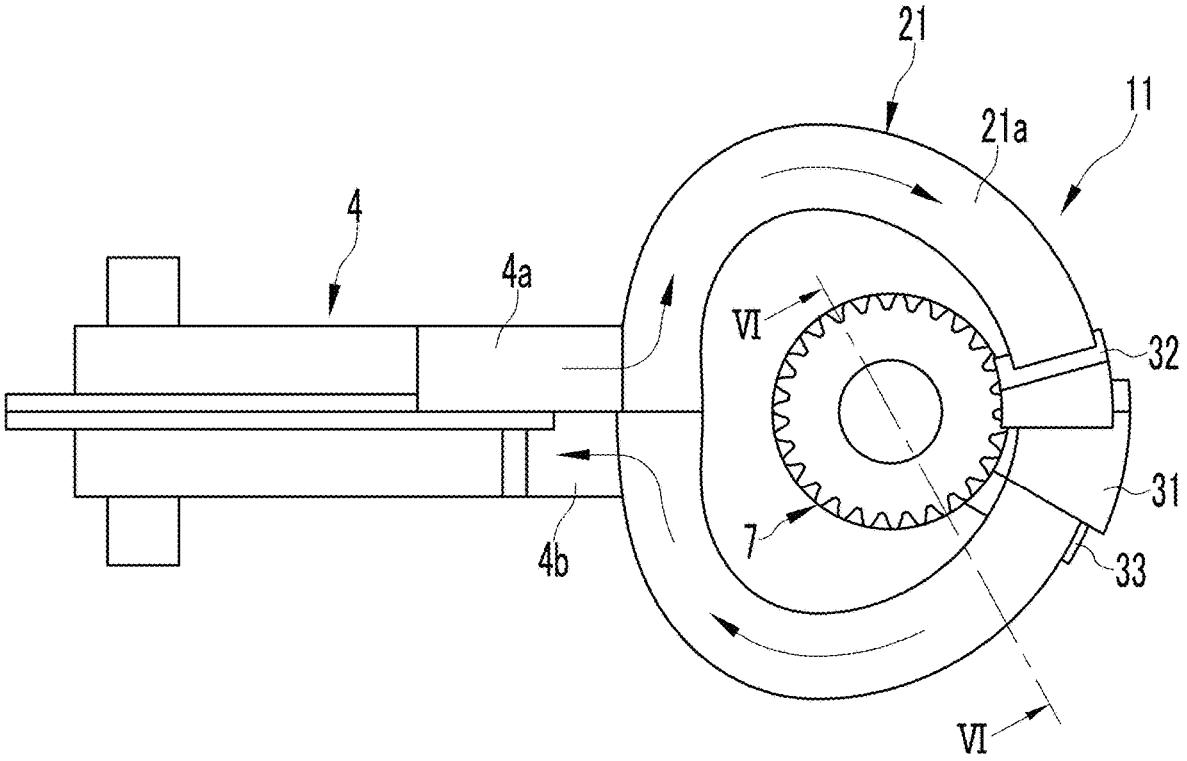
FIG. 2 is a top view illustrating a left heating coil and a helical gear.
Figure 3:
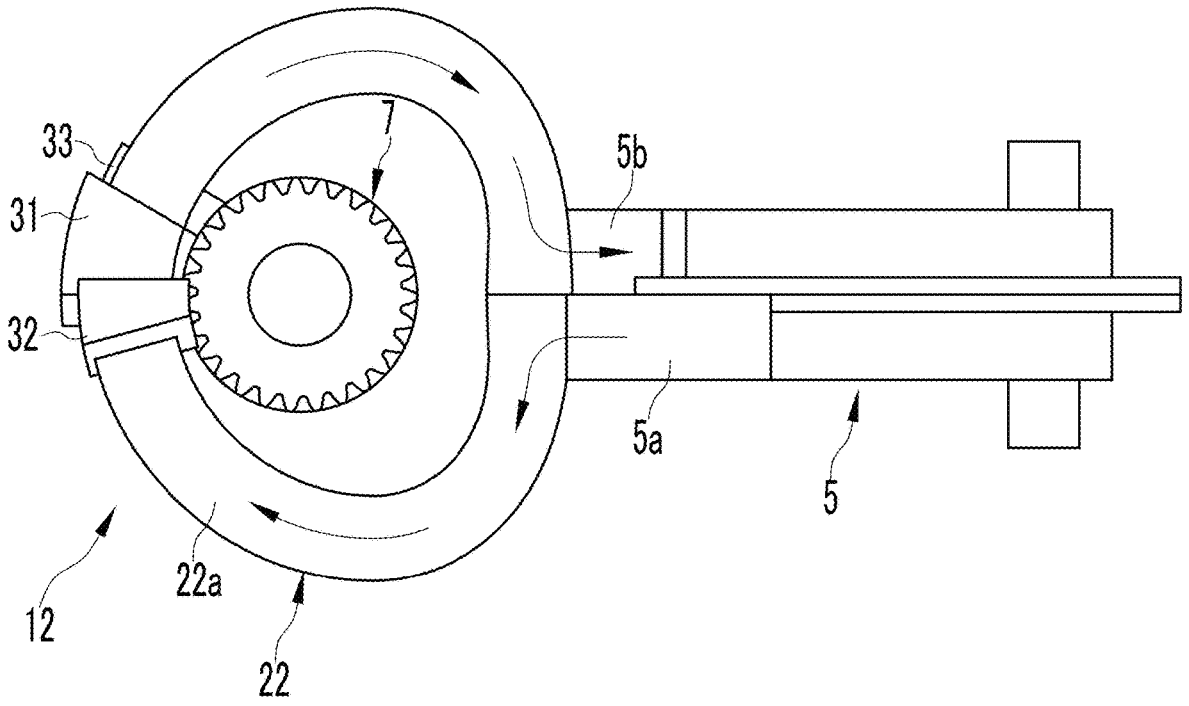
FIG. 3 is a top view illustrating a right heating coil and the helical gear.
Figure 4:
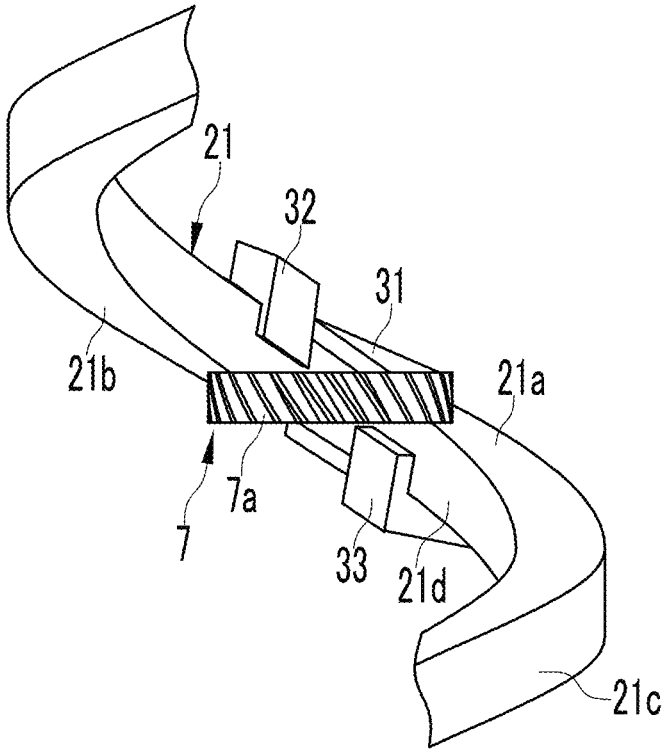
FIG. 4 is a front view illustrating a left conductor portion, the helical gear, a focusing magnetic body, an upper inducing magnetic body, and a lower inducing magnetic body.
Figure 5:
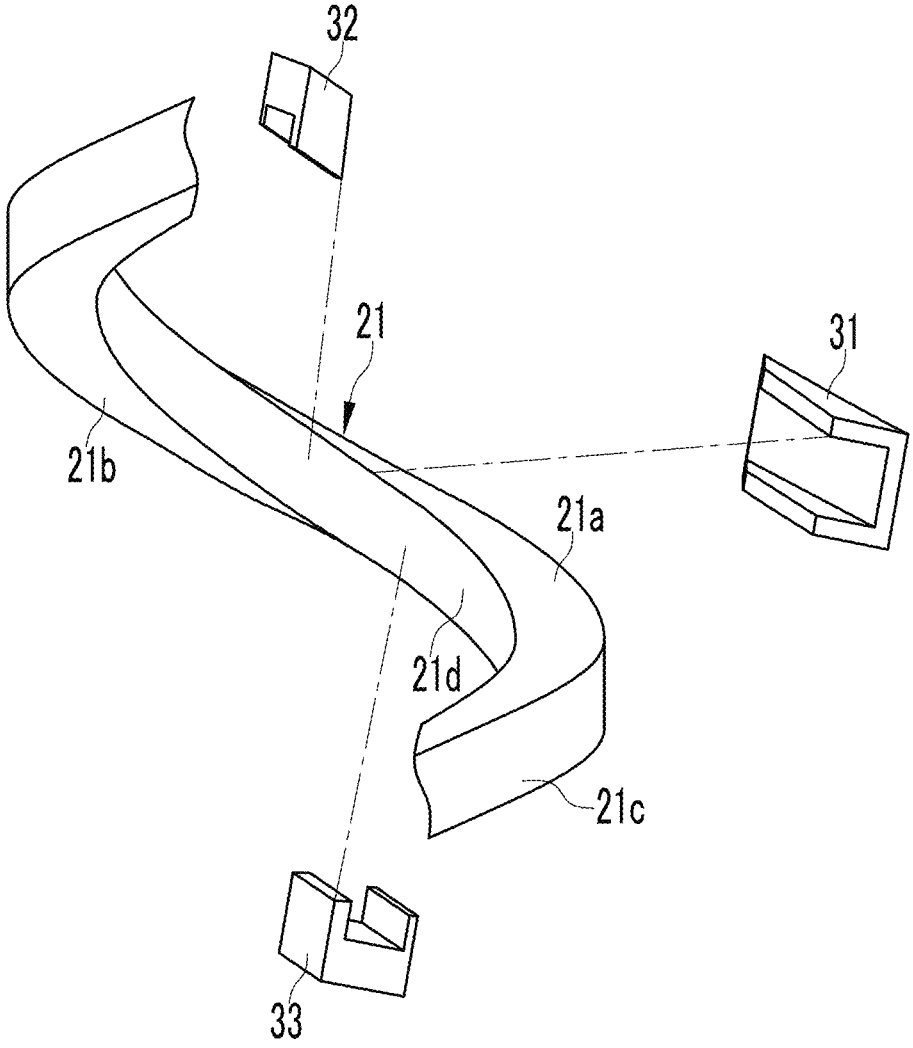
FIG. 5 is a front view illustrating a state in which the focusing magnetic body, the upper inducing magnetic body, and the lower inducing magnetic body are removed from the left conductor portion.

As illustrated in FIGS. 1 to 3, the heating apparatus 2 includes a high frequency power supply 3 which supplies a high frequency current, and a left conductive plate 4 and a right conductive plate 5 which are connected to the high frequency power supply 3 via a connection cord (unillustrated). For example, the heating apparatus 2 quench-hardens a gear tooth 7*a* (concave and convex portion) of a metal helical gear 7 (workpiece).

The heating apparatus 2 includes a left heating coil 11, both ends of which are connected to the left conductive plate 4 and which surrounds the gear tooth 7*a* of the helical gear 7; and a right heating coil 12, both ends of which are connected to the right conductive plate 5 and which surrounds the gear tooth 7*a*. Hereinafter, the left heating coil 11 and the tight heating coil 12 are collectively referred to as left and right heating coils 11 and 12.

In the present embodiment, at the time of preheating, a low frequency power supply (unillustrated) is connected only to the left conductive plate 4 to supply a low frequency (for example, 4 to 8 kHz) current, whereby a low frequency current flows through the left heating coil 11 and a high frequency (for example, 40 to 60 kHz) current flows through the right heating coil 12. Currents of two different frequencies are used to provide ranges for magnetic permeability, thereby to enable preheating at a desired depth from the surface of the gear tooth 7*a*.

Further, the heating apparatus 2 includes a support portion 13 which supports the helical gear 7; and a rotating/moving unit 14 which rotates and moves the support portion 13. The rotating/moving unit 14 rotates the support portion 13 about the central axis direction of the helical gear 7 and moves the support portion 13 in the axial direction of the helical gear 7.

The left conductive plate 4 includes a left inlet side conductive plate 4*a* for receiving a high frequency current supplied from the high frequency power supply 3; and a left outlet side conductive plate 4*b* for returning the high frequency current passing through the left inlet side conductive plate 4*a* and the left heating coil 11 to the high frequency power supply 3. There is a gap between the left inlet side conductive plate 4*a* and the left outlet side conductive plate 4*b*.

Likewise, the right conductive plate 5 includes a right inlet side conductive plate 5*a* for receiving a high frequency current from the high frequency power supply 3; and a right outlet side conductive plate 5*b* for returning the high frequency current passing through the right inlet side conductive plate 5*a* and the right heating coil 12 to the high frequency power supply 3. There is a gap between the right inlet side conductive plate 5*a* and the right outlet side conductive plate 5*b*.

The left heating coil 11 includes a left conductor portion 21 made of metal (for example, copper) formed in a rectangular cylindrical spiral shape. The left conductor portion 21 includes an upper surface 21*a*, a lower surface 21*b*, an outer surface 21*c*, and an inner surface 21*d*. Each of the upper surface 21*a*, the lower surface 21*b*, and the outer surface 21*c* is a non-facing, surface which does not face the gear tooth 7*a*. The inner surface 21*d* is a facing surface where a part thereof faces the gear tooth 7*a*. The left conductor portion 21 is formed such that the curvature in the circumferential direction of the inner surface 21*d* is less than the curvature of the outer peripheral surface of the helical gear 7.

The right heating coil 12 includes a right conductor portion 22 made of metal (for example, copper) formed in a rectangular cylindrical spiral shape. The right conductor portion 22 includes an upper surface 22*a*, a lower surface 22*b*, an outer surface 22*c*, and an inner surface 22*d*. Each of the upper surface 22*a*, the lower surface 22*b*, and the outer surface 22*c* is a non-facing surface which does not face the gear tooth 7*a*. The inner surface 22*d* is a facing surface where a part thereof faces the gear tooth 7*a*. The right conductor portion 22 is formed such that the curvature in the circumferential direction of the inner surface 22*d* is less than the curvature of the outer peripheral surface of the helical gear 7.

The left conductor portion 21 is formed such that the upper end thereof is connected to the left inlet side conductive plate 4*a* and the lower end thereof is connected to the left outlet side conductive plate 4*b*.

The right conductor portion 22 is formed such that the upper end thereof is connected to the tight inlet side conductive plate 5*a* and the lower end thereof is connected to the right outlet side conductive plate 5*b*. Hereinafter, the left conductor portion 21 and the right conductor portion 22 are collectively referred to as left right conductor portions 21 and 22.

A coolant supply machine 27 is connected to the left tight conductor portions 21 and 22. Coolant supplied from the coolant supply machine 27 passes through inside the cylindrical left right conductor portions 21 and 22 and is recovered by a recovery machine (unillustrated).

The left right conductor portions 21 and 22 are formed so as to face the gear tooth 7*a* of the helical gear 7 and extend in a direction orthogonal to a direction in which the gear tooth 7*a* extends. The left conductor portion 21 and the right conductor portion 22 are formed to have the same shape and disposed facing each other at a position rotated by 180° about the central axis of the helical gear 7. Note that the orthogonal direction also includes a direction slightly deviated from the orthogonal direction.

As illustrated in FIGS. 1 to 6, the left heating coil 11 includes a focusing magnetic body 31 (first magnetic body) which is disposed at a portion of the left conductor portion 21 facing the gear tooth 7*a*; covers the upper surface 21*a*, the lower surface 21*b*, and the outer surface 21*c* except for the inner surface 21*d*; and focuses the magnetic flux at the left conductor portion 21 and concentrates the magnetic flux on the surface of the gear tooth 7*a* of the helical gear 7.

The left heating coil 11 includes an upper inducing magnetic body 32 (second magnetic body) which covers the upper surface 21*a* of the left conductor portion 21, an upper portion of the outer surface 21*c*, and an upper side portion (outside portion) of the inner surface 21*d* located on an upper side of a portion facing the gear tooth 7*a*; and induces a part of the magnetic flux flowing in a tooth root (concave portion) of the gear tooth 7*a* into a tooth tip (convex portion) of the gear tooth 7*a*. Note that the upper inducing magnetic body 32 may cover at least the upper surface 21*a* and the upper side portion (outside portion) of the inner surface 21*d* located on an upper side of a portion facing the gear tooth 7*a*.

Further, the left heating coil 11 includes a lower inducing magnetic body 33 (second magnetic body) which covers the lower surface 21*b*, a lower portion of the outer surface 21*c*, a lower side portion (outside portion) of the inner surface 21*d*, located on the lower side of a portion facing the gear tooth 7*a*, and which induces a part of the magnetic flux flowing in the tooth root of the gear tooth 7*a* into the tooth tip of the gear tooth 7*a*. Note that the lower inducing magnetic body 33 may cover at least the lower surface 21*b*, and the lower side portion (outside portion) of the inner surface 21*d*, located on a lower side of a portion facing the gear tooth 7*a*.

Figure 6:
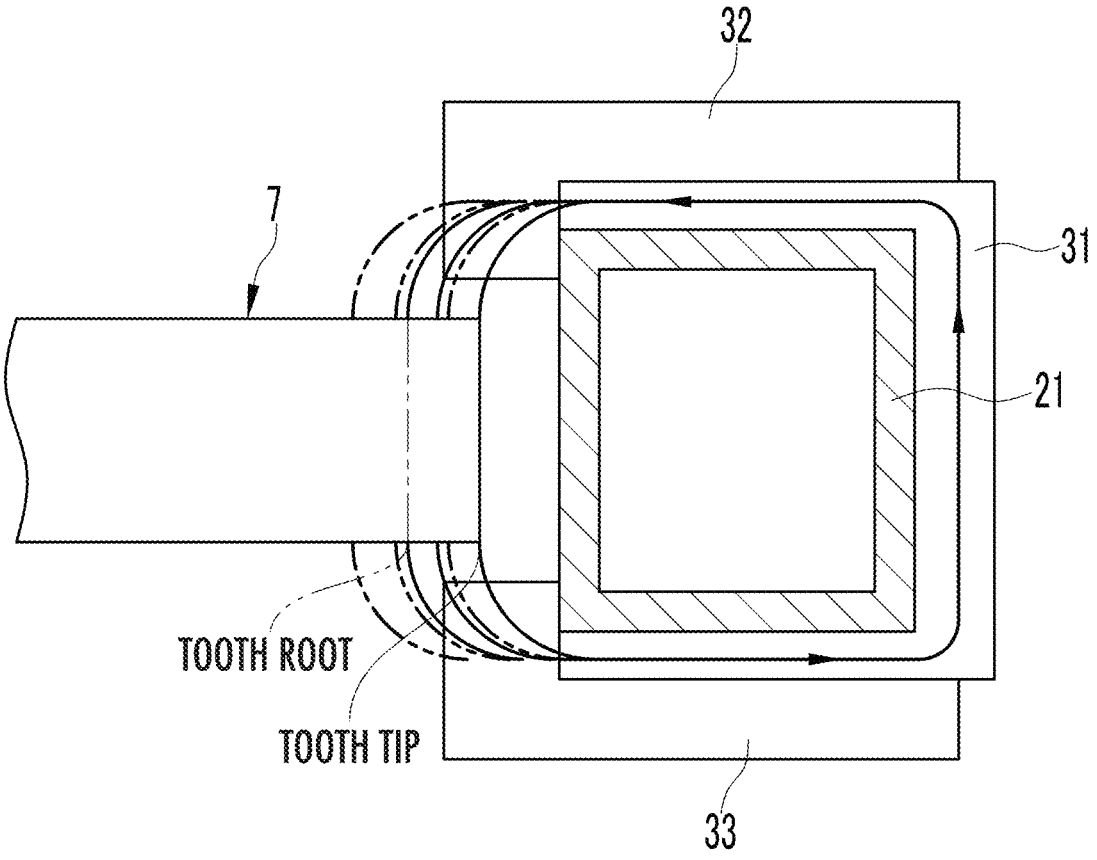
FIG. 6 is a sectional view along line VI-VI illustrating the left conductor portion, the helical gear, the focusing magnetic body, the upper inducing magnetic body, and the lower inducing magnetic body.

Note also that in the present embodiment, the upper inducing magnetic body 32 and the lower inducing magnetic body 33 are formed such that the vertical thickness thereof in FIG. 6 is greater than the vertical thickness of the focusing magnetic body 31 in FIG. 6, but without being limited to this, the vertical thickness of the focusing magnetic body 31, the upper inducing magnetic body 32, and the lower inducing magnetic body 33 in FIG. 6 may be of any thickness as long as at least the magnetic flux does not diffuse.

The upper inducing magnetic body 32 and the lower inducing magnetic body 33 are disposed adjacently to the focusing magnetic body 31. Note that FIG. 6 schematically illustrates the left conductor portion 21 and each of the magnetic bodies 31 to 33 as straight lines, and only the left conductor portion 21 as the cross section.

Likewise, the right heating coil 12 includes the focusing magnetic body 31, the upper inducing magnetic body 32, and the lower inducing magnetic body 33 (see FIG. 3). The focusing magnetic body 31, the upper inducing magnetic body 32, and the lower inducing magnetic body 33 are made of, for example, ferrite. Further, the focusing magnetic body 31, the upper inducing magnetic body 32, and the lower inducing magnetic body 33 are fixed to the left right conductor portions 21 and 22, for example, by an adhesive.

[Quench-Hardening]

When the gear tooth 7*a* of the helical gear 7 is quench-hardened, the helical gear 7 is placed on the support portion 13 as illustrated in FIG. 1. Then, the high frequency power supply 3 is driven to supply a high frequency current to the left right conductor portions 21 and 22 of the left and right heating coils 11 and 12 through the left conductive plate 4 and the right conductive plate 5. Then, the rotating/moving unit 14 vertically moves and rotates the support portion 13.

When a high frequency current flows into the left right conductor portions 21 and 22, a magnetic force is generated inside the left right conductor portions 21 and 22 by electromagnetic induction, whereby the helical gear 7, particularly the gear tooth 7*a*, surrounded by the left right conductor portions 21 and 22 is heated.

The left right conductor portions 21 and 22 are formed so as to extend in a direction orthogonal to the direction in which the gear tooth 7*a* extends, and thus can suppress the gear tooth 7*a* from being unevenly heated in comparison with a case in which the gear tooth 7*a* is heated using a heating coil extending in a direction not orthogonal to the direction in which the gear tooth 7*a* extends.

When the helical gear 7 is heated by electromagnetic induction, the focusing magnetic body 31 focuses the magnetic flux in the left right conductor portions 21 and 22 and concentrates the magnetic flux on the surface of the gear tooth 7*a* of the helical gear 7. This enables the gear tooth 7*a* to be reliably heated. In addition, the support portion 13 vertically moves and rotates, and thus can evenly heat the entire gear tooth 7*a*. Note that the term "evenly" includes one slightly shifted from evenly.

When the helical gear 7 is heated by electromagnetic induction, the upper inducing magnetic body 32 and the lower inducing magnetic body 33 induces a part of the magnetic flux flowing in the tooth root of the gear tooth 7*a* into the tooth tip of the gear tooth 7*a*.

The solid line in FIG. 6 indicates the direction of the magnetic flux in the case of providing the upper inducing magnetic body 32 and the lower inducing magnetic body 33; and the two-dot chain line in FIG. 6 indicates the direction of the magnetic flux in the case of not providing the upper inducing magnetic body 32 or the lower inducing magnetic body 33. Note that the direction of the magnetic flux in FIG. 6 is just for convenience.

In the case of providing the upper inducing magnetic body 32 and the lower inducing magnetic body 33 (solid line in FIG. 6), the magnetic flux directed to the tooth tip of the gear tooth 7*a* increases more than in the case of not providing the upper inducing magnetic body 32 or the lower inducing magnetic body 33 (two-dot chain line in FIG. 6). This can prevent heat from being concentrated on the tooth root of the gear tooth 7*a*, thereby enabling both the tooth tip and the tooth root of the gear tooth 7*a* to be reliably heated.

The helical gear 7 is heated by electromagnetic induction for a predetermined time, and then the high frequency power supply 3 stops driving. When the frequency power supply 3 stops driving, the high frequency current stops being supplied to the left right conductor portions 21 and 22, and then heating by electromagnetic induction stops.

Then, the coolant supply machine 27 is driven to supply coolant to the left right conductor portions 21 and 22. The coolant supplied from the coolant supply machine 27 passes through inside the cylindrical left right conductor portions 21 and 22 and is recovered in the recovery machine. This coolant cools the left right conductor portions 21 and 22.

A coolant tank (unillustrated) is provided below the left and right heating coils 11 and 12. After the heating ends, the helical gear 7 is placed in the coolant tank. Inside the coolant tank, coolant is injected to the helical gear 7 to cool the helical gear 7, particularly the gear tooth 7*a*.

The gear tooth 7*a* is heated and then cooled, thereby to be quench-hardened. After the helical gear 7 is sufficiently cooled, the rotating/moving unit 14 stops driving, and then the helical gear 7 is removed from the support portion 13. Note that before the helical gear 7 is placed in the coolant tank, the rotating/moving unit 14 may stop rotating the helical gear 7.

Figure 7:
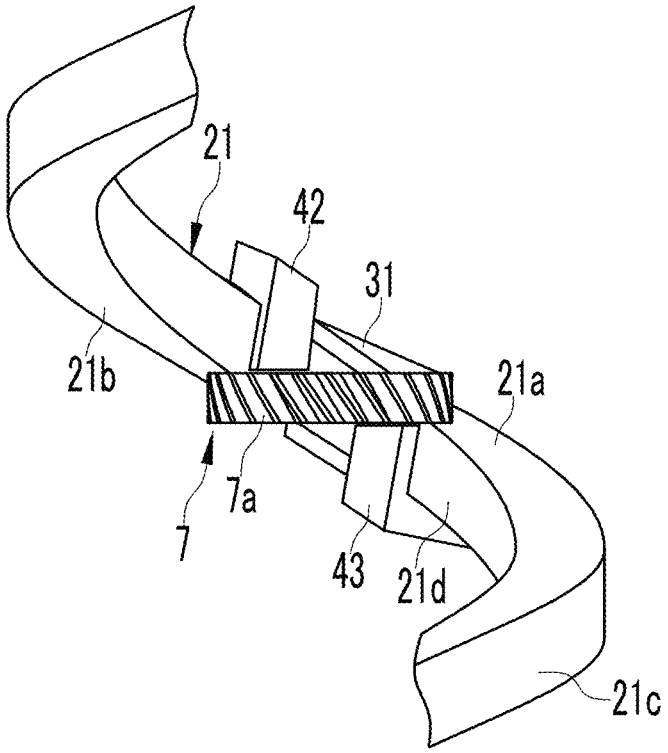
FIG. 7 is a front view illustrating a left conductor portion, a helical gear, a focusing magnetic body, an upper inducing magnetic body, and a lower inducing magnetic body according to a second embodiment.

Note that as illustrated in FIG. 7, an upper inducing magnetic body 42 and a lower inducing magnetic body 43 may be formed to be larger as the range covering the upper side portion and the lower side portion of the inner surface 21*d* of the left heating coil 11, the portions facing the gear tooth 7*a*, is further away from the focusing magnetic body 31 in the circumferential direction of the helical gear 7. This shape can further prevent heat from being concentrated on the tooth root of the gear tooth 7*a*.

EXAMPLE

Figure 8:
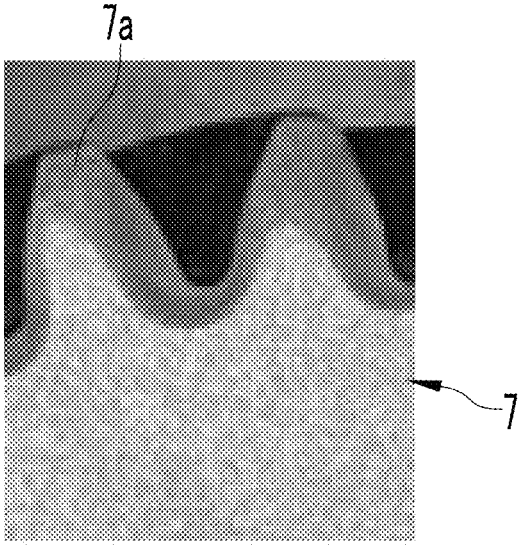
FIG. 8 is a view illustrating the helical gear heated by the heating coil having the upper inducing magnetic body and the lower inducing magnetic body.

The gear tooth 7*a* of the helical gear 7 was quench-hardened using the heating apparatus 2 having the left and right heating coils 11 and 12 according to the present invention. FIG. 8 shows the helical gear 7 of the example after quench hardening.

Figure 9:
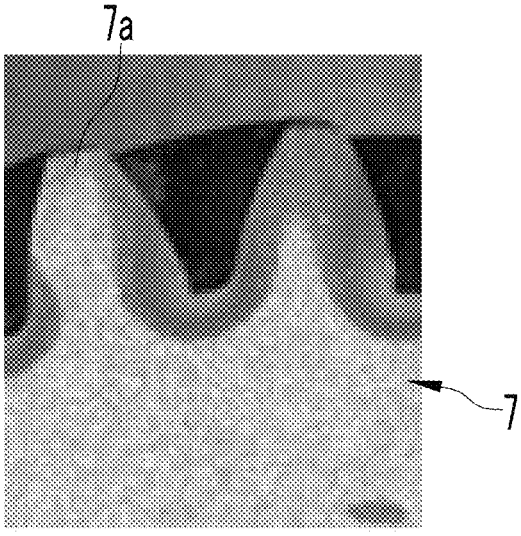
FIG. 9 is a view illustrating the helical gear heated by the heating coil not having the upper inducing magnetic body or the lower inducing magnetic body.

As a comparative example, the gear tooth 7*a* of the helical gear 7 was quench-hardened using a conventional heating coil not having the upper inducing magnetic body 32 and the lower inducing magnetic body 33. FIG. 9 shows the helical gear 7 of the comparative example after quench hardening. Note that dark-colored portions in FIGS. 8 and 9 indicate the quench-hardened portions.

As illustrated in FIG. 9, in the comparative example using a conventional heating coil for quench-hardening, the tooth roots of the gear tooth 7*a* were quench-hardened, but some tooth tips of the gear tooth 7*a* were not quench-hardened.

Meanwhile, as illustrated in FIG. 8, in the example of quench-hardening using the left and right heating coils 11 and 12 according to the present invention, both the tooth tips and the tooth roots of the gear tooth 7*a* were quench-hardened.

In the above embodiment, the left heating coil 11 and the right heating coil 12 are provided, but only one of them may be provided. In this case, the same effect as in the above embodiment can be obtained.

In the above embodiment, the helical gear is used as the workpiece, but the workpiece is not limited to this, and any workpiece may be used as long as the inclined concave and convex portions are formed on the outer peripheral surface.

What is claimed is:

1. A heating coil which is configured for heating concave and convex portions of a workpiece formed in a cylindrical shape, the concave and convex portions extending in a direction inclined with respect to a central axis of the workpiece and being formed on an outer peripheral surface of the workpiece, the heating coil comprising:

a conductor portion configured to be disposed outside the workpiece, the conductor portion formed in a configuration so as to extend in a direction orthogonal to an inclination direction of the concave and convex portions formed on the outer peripheral surface of the workpiece, the outer peripheral surface of the workpiece having a circular shape when viewed in plan view with the workpiece received for heating by the heating coil, and the outer peripheral surface of the workpiece being parallel to the central axis of the workpiece, and the conductor portion having a facing surface configured on a part of the conductor portion facing the central axis of the workpiece and a non-facing surface configured on a part of the conductor portion where the conductor portion does not face the central axis of the workpiece;

a first magnetic body configured to cover the non-facing surface of the conductor portion; and a second magnetic body set configured to be disposed adjacently to the first magnetic body, wherein the second magnetic body set is configured so that it covers a width of the non-facing surface and an upper outside portion of the facing surface and a lower outside portion of the facing surface, the second magnetic body set configured to be located at an upper side and a lower side outside of a portion of the conductor portion that faces the concave and convex portions, and the second magnetic body set is configured to expose the portion of the facing surface facing the concave and convex portions so that the facing surface has an area configured to be exposed to the workpiece between the upper outside portion and the lower outside portion.

2. The heating coil according to claim 1, wherein the second magnetic body set is formed such that a range covering the outside portion of the facing surface increases as it moves away from the first magnetic body in a circumferential direction of the workpiece.

3. The heating coil according to claim 1, wherein the conductor portion extends spirally and a curvature in a circumferential direction of the facing surface is configured to be less than a curvature of the outer peripheral surface of the workpiece.

* * * * *